US006338687B1

(12) United States Patent
Thompson

(10) Patent No.: US 6,338,687 B1
(45) Date of Patent: Jan. 15, 2002

(54) BATTING SWING INDICATOR

(76) Inventor: Joseph E. Thompson, 1601 Dain Dr., Carmi, IL (US) 62821

( * ) Notice: Subject to any disclaimer, the term of this patent is extended or adjusted under 35 U.S.C. 154(b) by 0 days.

(21) Appl. No.: 09/332,397

(22) Filed: Jun. 14, 1999

(51) Int. Cl.[7] ..... A63B 69/00

(52) U.S. Cl. ..... 473/453; 473/564; 473/437; 273/317.6

(58) Field of Search ..... 473/415–421, 473/221, 437, 461, 451–457, FOR 103, FOR 105, 589; 273/317.6; 124/5; 446/48

(56) References Cited

U.S. PATENT DOCUMENTS

| | | | | | |
|---|---|---|---|---|---|
| 1,529,851 | A | * | 3/1925 | Smithson | |
| 2,086,493 | A | * | 7/1937 | Ellingwood | 63/3 |
| 3,176,673 | A | * | 4/1965 | Dill | |
| 3,521,883 | A | * | 7/1970 | Hamilton | 473/437 |
| 3,970,307 | A | * | 7/1976 | Breglia | |
| 3,971,559 | A | * | 7/1976 | Diforte, Jr. | 473/437 |
| 4,030,472 | A | * | 6/1977 | Watkins | |
| 4,174,834 | A | * | 11/1979 | De Martino | 473/514 |
| 4,180,262 | A | * | 12/1979 | Gabrielidis | 473/464 |
| 4,329,807 | A | * | 5/1982 | Atkinson | |
| 4,577,863 | A | | 3/1986 | Ito et al. | 273/26 R |
| 5,024,436 | A | * | 6/1991 | Vento | 473/437 |
| 5,595,384 | A | | 1/1997 | Hardison | 473/453 |
| 5,695,419 | A | | 12/1997 | Haringa | 473/564 |
| 5,776,004 | A | * | 7/1998 | Wilson | |

* cited by examiner

*Primary Examiner*—Sebastiano Passaniti
*Assistant Examiner*—Mitra Aryanpour
(74) *Attorney, Agent, or Firm*—Spencer Fane Britt & Browne LLP

(57) ABSTRACT

A batting swing device is presented which enables a batter to determine whether or not his swing is good or bad. The device is designed for use by both baseball and softball players. It is intended to teach hitters the correct path that a bat must travel during a swing in order to most effectively hit a ball to all parts of a playing field. The device is approximately 5 inches in outer diameter and three inches in inner diameter, and shaped similar to a doughnut. The inner diameter is flat to enable the device to easily slip on and off a baseball bat. The device is made of polyethylene plastic and weighs approximately two ounces. When a batter takes a swing with the device slipped onto the bat and above the batter's hands, the direction of travel of the device will determine whether or not the batter has made a good swing. If the device travels towards the pitcher's mound, or within a 50 degree angle measured off of the pitcher's mound, the batter's swing was a correct one. On the other hand, if the device travels to either the left or the right of the desired 50 degree angle, the batter has swung the bat incorrectly. Depending on which side the device lands, the batter will be able to discover the flaws in his swing.

2 Claims, 4 Drawing Sheets

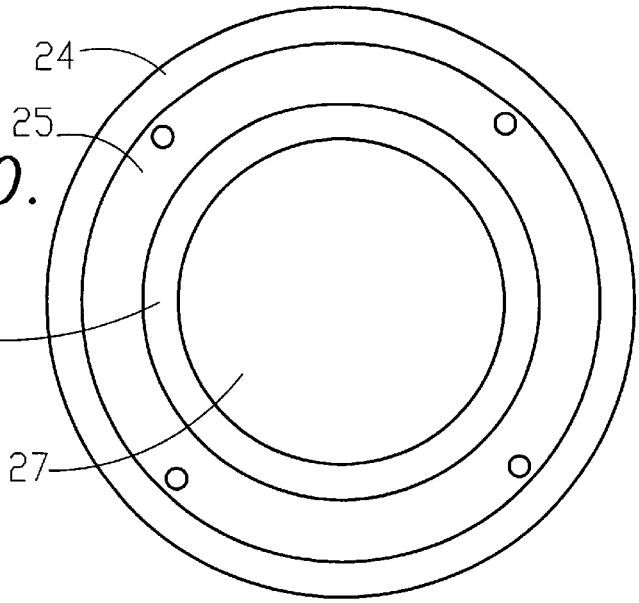
Fig. 10.
Fig. 9.
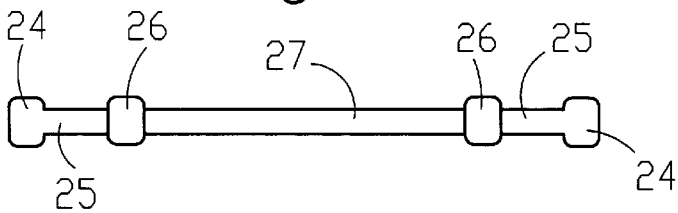
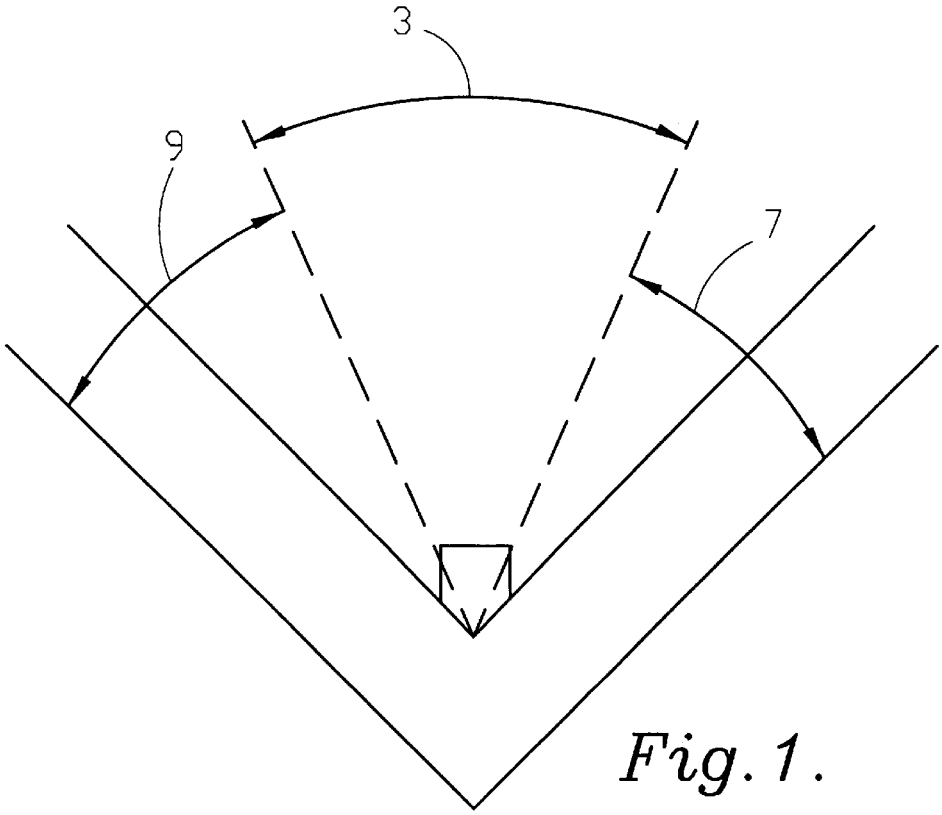
Fig. 1.

30
1'
2
1

8
2
5'
5
21

20
4'
6'
6
2
4

Fig. 7.
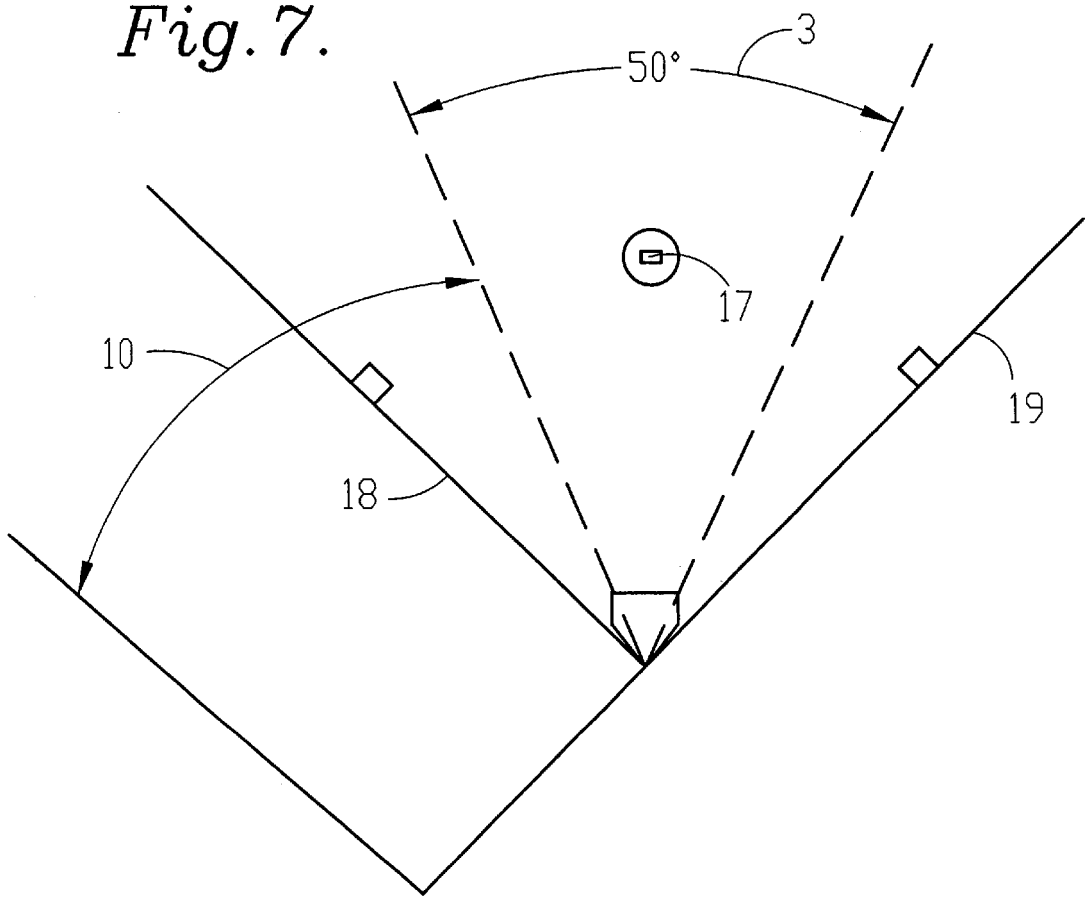
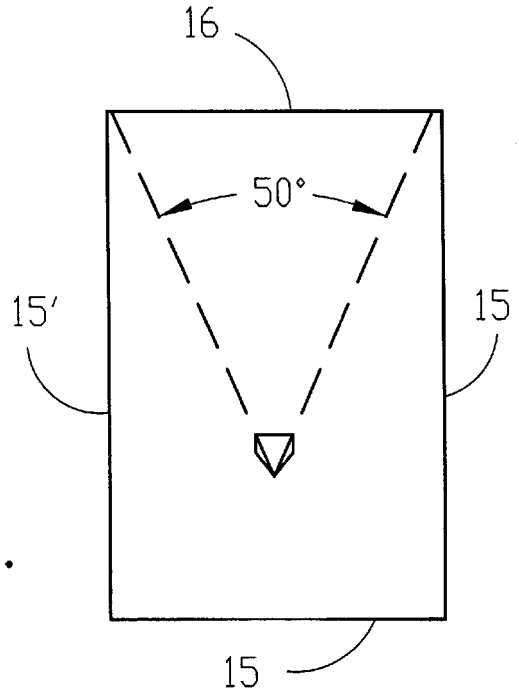
Fig. 8.

BATTING SWING INDICATOR

BACKGROUND OF THE INVENTION

This invention relates to the field of baseball training devices. More particularly, a Batting Swing Indicator also known as a PHD Trainer is provided which slides onto a baseball bat and indicates the swing of a baseball batter.

Baseball has been known in this Country and throughout the World for at least 150 years. In this time, many new devices have been devised to improve pitching, catching, and most importantly, batting. These batting devices have been utilized to increase the strength of the batter, the bat speed, and in some cases, the swing of the batter. This particular device is designed to indicate whether or not a batting swing is done correctly. In a correct swing, the barrel of the bat is perpendicular to the line of the pitch for the longest possible period. It is the alignment of the path of travel of the barrel of the bat with the line of the pitch that enables a hitter to perfect his swing.

There have been a number of baseball practice attachments for baseball bats heretofore known in the prior art. One such example is the U.S. Pat. No. 5,695,419, issued in 1997 to Haringa. The Haringa attachment for bats is designed principally for use in batting practice. The Haringa device is a cover for the barrel of the bat that does not significantly change its weight, feel or shape but protects the bat from developing knicks or other imperfections during batting practice. While Haringa is used to protect the bat, other devices have been devoted to the field of perfecting the batter's swing.

Both the 1986 patent issued to Ito (U.S. Pat. No. 4,577,863) and the 1997 patent issued to Hardison (U.S. Pat. No. 5,595,384) are directed towards perfecting the batter's swing. The Ito device measures the height and inclination of a batter's swing. Ito uses a homeplate device which includes a laser source and photosensors for detecting laser light reflected by the bat when swung over the plate. While Ito is a high technology device, it may be impractical in use for teaching youngsters or high school age athletes. Although Ito will measure a swing, simpler devices would suffice in the teaching of the batting swing.

One such simpler device is the bat swing guide disclosed by Hardison in 1997. Hardison uses a form and rail to guide the bat as the batter swings at the ball placed on a T. While the Hardison device may be quite useful, it does not simulate the actual swing without the guide and hence is of limited usefulness.

One object of this invention is to provide a useful device for developing a batter's swing that is both durable and economical to manufacture and use. Another object of this invention is to provide a batting swing guide indicator and method of teaching which closely simulates the actual swing of a batter at a pitch.

A still further object of this device is to provide a simple and economical batting swing indicator which will readily disclose to the batter whether he has moved the bat in accordance with proper principals for batting or whether the bat has been moved either too quickly, or in too much of a circular fashion to enable a high percentage of balls to be hit into the desireable locations. Other and further objects of this device will become apparent upon viewing the below described Specification and Drawings.

BRIEF DESCRIPTION OF THE DEVICE

A doughnut-shaped batting swing indicator is disclosed which is approximately 5 inches in outside diameter, 3 inches in inside diameter, ½ inch thick and which weighs approximately two ounces. The guide is placed over the barrel of a bat and the batter takes a simulated swing at a baseball. If the guide lands in a direction located between homeplate and the shortstop and second base position, the batting swing is deemed to have been correct. If the swing guide device lands outside that area, the path and location of the final resting place of the device discloses to the batter the particular problem with his swing.

BRIEF DESCRIPTION OF THE DRAWING FIGURES

FIG. 1 is a schematic device of homeplate and the infield of a baseball diamond. FIG. 1 is a graphic depiction of a baseball diamond and demonstrates the desired and undesired locations for the final resting place of this device when a batter has swung.

FIG. 7 is a schematic view of the device showing the correct and incorrect final resting places for the batting device.

FIG. 8 is a schematic representation of the proper angles of flight for the device when used in conjunction with a batting cage.

FIG. 9 is a side view of a second embodiment of the device.

FIG. 10 is a top view of the second embodiment of the device, shown in FIG. 9.

DETAILED DESCRIPTION OF THE DEVICE

The PHD Trainer device is designed for use by baseball and softball players. The device is intended to teach hitters the correct path which a bat must travel during a swing in order to most effectively hit a ball to all parts of a playing field. When used correctly, the device is designed for use in two ways to teach baseball and fast pitch softball players the correct way to use their hands when swinging the bat.

Figures 2, 3, 4:
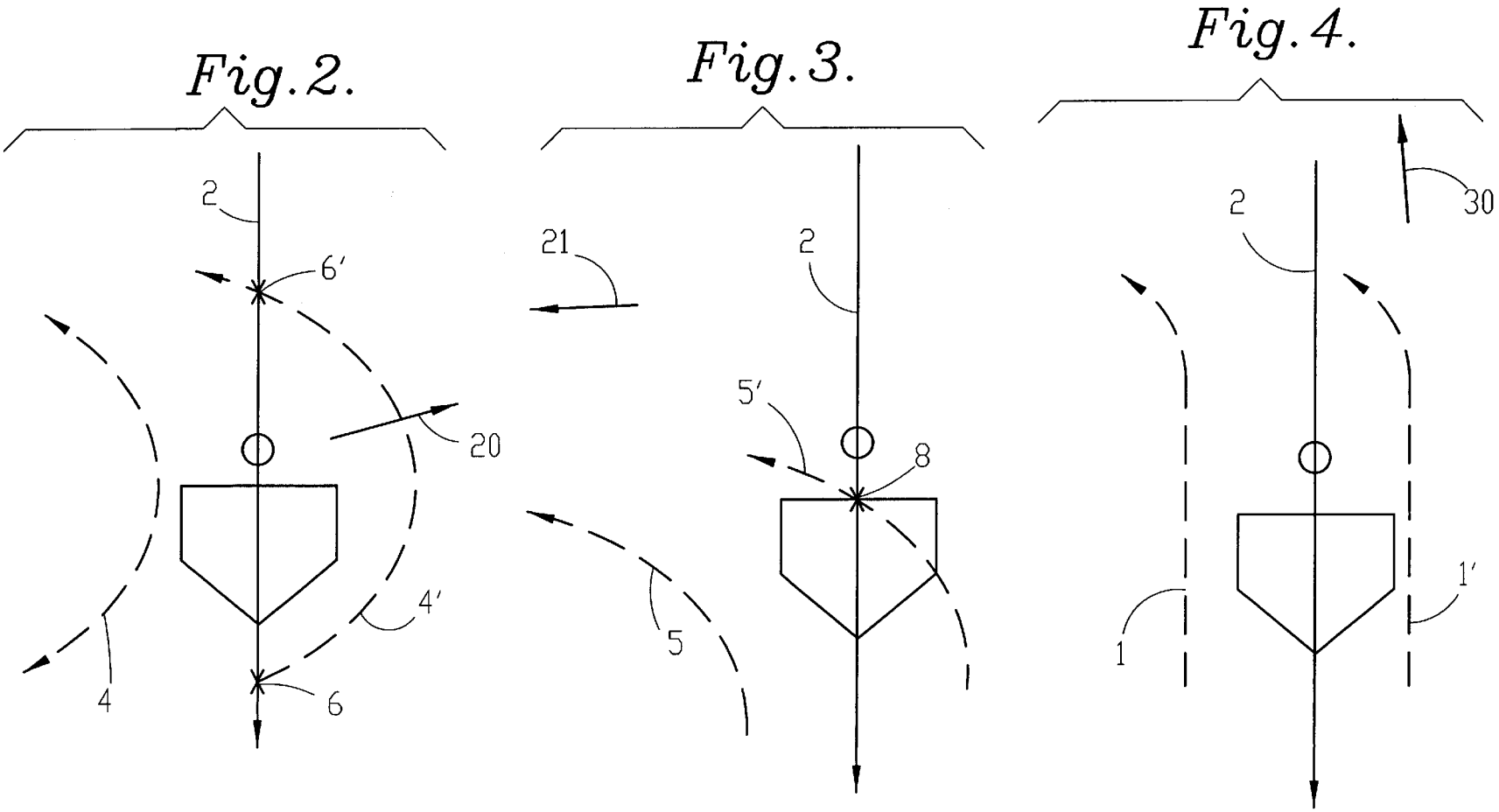
FIG. 2 is a schematic representation of an incorrect swing common in young hitters.
FIG. 3 is a schematic depiction of an incorrect swing where a hitter's hand has moved in a circular motion around the body, a common flaw in hitters.
FIG. 4 is a schematic representation of the correct swing of an experienced and accomplished batter.

When a hitter swings at a pitched ball, it is important for him to place his hands on a line parallel to the line of travel of the ball and to move the hands along the established parallel line for as long as possible. As best shown in FIG. 4, if the line of the hands 1 of a hitter travel basically parallel to the path of the ball 2, then the line of the barrel of the bat 1' will travel perpendicular to the path 2 of a ball for an extended period of time. With a hitter placing the barrel of his bat on the line of the pitched ball for a longer period of time, the chances for solid contact on the best part of the bat are greatly increased. If a hitter uses this device and successfully moves his hands on the prescribed line in the preferred batter's swing, the device will travel off the bat in a direction contained within the middle 50 degrees (3 on FIG. 1) in fair territory.

When utilizing this device, any time a hitter swings the bat and the device travels and comes to rest within the middle 50 degrees 3 of fair territory, it can be assumed that the hitter's hands were moving along a line that better enables a hitter to make solid contact in the middle part of the field. The only exception to this is if the batter swings the bat while his feet are opened or closed in a manner where a line drawn from the back toes to the front toes points outside the 50 degree zone. However, these are unusual circumstances and are not normally taught to youngsters or high school level hitters.

Utilizing the swing shown in FIG. 4, the batter's hands travel in a straight line parallel to the line of travel of the ball. By keeping the hands inside and parallel to the path of the ball, the barrel of the bat stays in line with the ball longer, allowing for a greater margin of error by the hitter. This swing causes the device to travel forward from the hitter in the correct direction.

One common mistake young hitters make while swinging a bat is to allow their hands to travel too far towards the line of the pitched ball and then complete the swing. This type of swing puts the barrel of the bat outside the line of the pitched ball for the majority of the swing, decreasing the chances for solid contact off the barrel of the bat. The ball can only be contacted with the barrel in two places, 6 and 6', both of which cause the ball to travel outside the desired 50 degree zone. This faulty batting swing is best illustrated in FIG. 2.

As depicted in FIG. 2, an incorrect swing is shown by the incorrect line of travel of the hands which results in an incorrect line of travel of the bat 4'. FIG. 2 illustrates that this incorrect swing will result in the barrel of the bat passing through the line of the pitched ball 2 at only two locations 6 and 6'. Since the barrel of the bat does not travel perpendicular to the line of the pitched ball 2 for an extended period of time, as shown in FIG. 4, the swing shown in FIG. 2 is a low percentage swing. If a hitter uses the device and swings the bat in the manner shown in FIG. 2, the device will slip off the bat and come to rest in the 20 degree zone of fair territory or foul territory 7 in the opposite field direction. In other words, if a right-handed hitter swings the bat and the device travels to the right, in the right 20 degree zone of fair territory or foul territory 7, and outside the desired 50 degree zone 3, the batter and coach know that the batter's hands are getting too far away from the batter's body too quickly during the swing.

This particular flaw is important for the hitter and coach to detect because when the hitter allows his hands to travel away from his body too quickly during the swing, the result is a slower swing that limits the opportunities for solid contact with the barrel of the bat.

Another common mistake is for hitters to prematurely take their hands off the appropriate line. This swing is illustrated schematically in FIG. 3. This swing does not allow for contacting the ball off of the barrel of the bat until the barrel has come so far around that a contacted ball goes foul. Hitters with this common flaw decrease the length of time the barrel of the bat is on line with the pitched ball. Another major drawback to this swing is that it forces a hitter to have near perfect timing because the center of the bat's barrel will contact the ball at only one place 8 along the line of the pitched ball.

In this incorrect swing, the hitter's hands have moved in a circle around his body. This hand and bat path causes a hitter to pull everything, and makes him susceptible to pitches on the outer half to one-third of the plate. A hitter with a swing like this will have difficulty handling an outside pitch. This premature circling of the body with the hands causes hitters to hit balls off the end of the bat or simply to miss strikes on the outer part of the plate because the bat is traveling away from the line of the pitched ball.

As shown on FIG. 3, when the hitter's hands are prematurely pulled away from the plate, the line of the hands 5 causes the line of the bat 5' to cross the line of the ball 2 only once, as illustrated at point 8. In some cases, a hitter's hands circle the body so quickly that the barrel of the bat never gets to the line of the pitched ball.

When a hitter uses the instant device and swings the bat while prematurely circling the body with the hands, as shown in FIG. 3, the device will travel within the 20 degree zone of fair territory or foul territory 9, as shown on FIG. 1.

In further explanation, if a right-handed hitter swings in the manner shown in FIG. 3, the device will travel to the left side of the field, or in left foul territory, an undesired swing. When the swing is incorrect as shown in FIG. 3, the instant batting swing device will land to the left of the desired position in fair territory or will land in foul territory outside of the third base line. This foul territory for a right-handed batter is also shown at 10 in FIG. 7.

Figure 5:
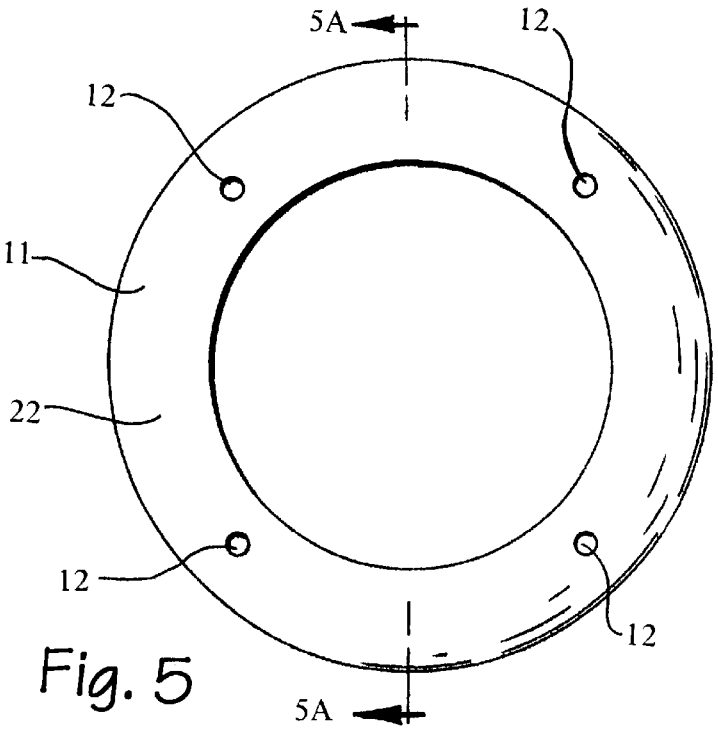
FIG. 5 is a top view of one embodiment of the device.
Figure 5A:
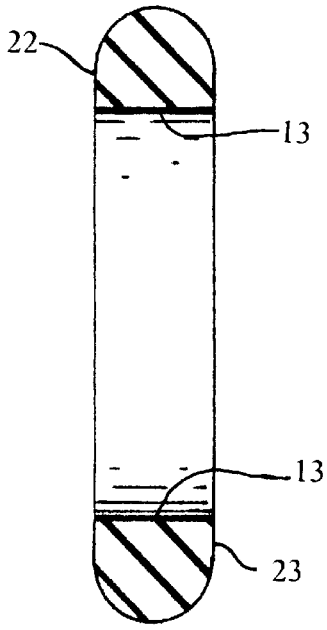
FIG. 5A is a cutaway view of the device shown in FIG. 5 taken along lines 5A—5A of FIG. 5.
Figure 6:
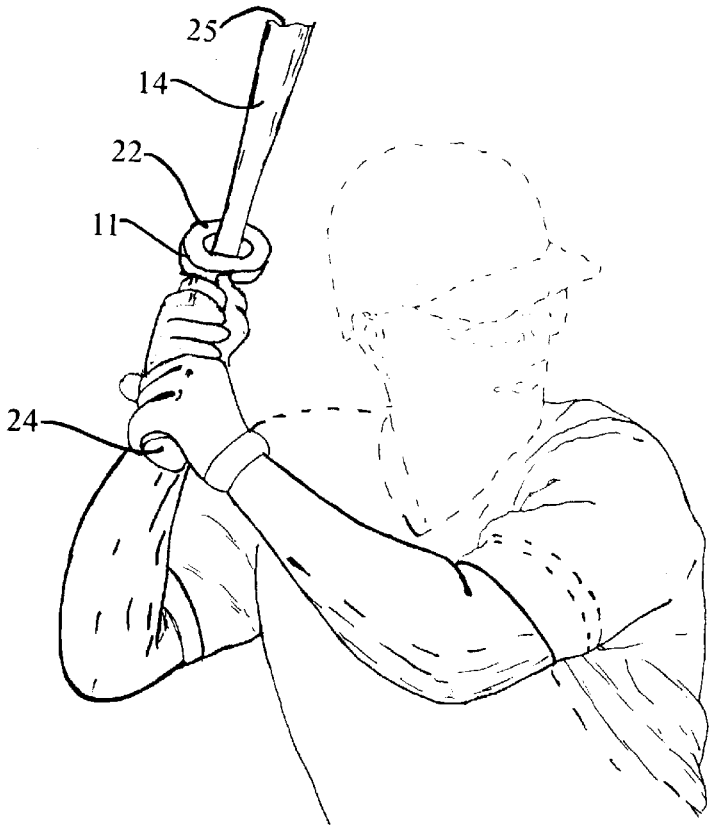
FIG. 6 is a pictorial representation of the device on a baseball bat, immediately prior to the swing.

One embodiment of the batting swing device 11 is shown in FIGS. 5, 5A, and 6. The device is made of durable material such as polyethylene. The doughnut-shaped ring has inside and outside diameters such that it will slide off of a swinging baseball bat, depending upon the type of swing. The device is made of soft, flexible polyethylene plastic so that it will not mar or damage the bat. It weighs approximately two ounces and has a plurality of small holes, 12, cut through the thickness of the device. The use of the small holes will be described below.

An alternative embodiment of the device is shown at FIGS. 9 and 10. This embodiment has the same general shape as the embodiment shown in FIGS. 5, 5A, and 6 but has a different cross-section. As shown in FIGS. 9 and 10, a second embodiment comprises an outer ring 24 attached to a central flat surface 25 attached to an inner ring 26. The inside 27 of the inner ring is open to enable the hitter to slide the device over the bat as before.

The outer dimensions of this device is 5.0 inches. The width of the outer ring 24 is one-half inch. The flat surface 25 connecting the outer 24 and inner 26 rings is 0.2 inches thick. The inner ring has an outer diameter of three and a half inches. The inner diameter of the device is three inches. The inner and outer rings are 0.45 inches high. These rings have a generally rectangular cross-section, as shown on FIG. 9. However, the corners of the rings are rounded.

The actual precise dimensions of the device may be expressed in general terms. These dimensions are meant as a means of illustration only, and not as a specific limitation on the device. However, the approximate parameters given herein should be maintained so as to allow the device to easily slip on and off the baseball bat when the bat is swung.

Generally, the outside diameter of the device is 5 inches, while the inside diameter is approximately 3 inches. The device has a cross-section of approximately one-half inch with an inner diameter large enough to slip the device on and off of a baseball bat. The inner diameter of the first embodiment of the device comprises a flat surface 13, which is perpendicular to the upper 22 and lower 23 surfaces of the device. The four holes 12 run through the body of the device and are approximately 0.1875 inches diameter. The holes are located at approximately 90 degree angles to the concentric center of the device. Since a bat normally has a maximum diameter of 2 and ⅝", it has been found that an inside diameter of 3" is most appropriate. For younger hitters, the bats may have a maximum diameter of no more than 2¼", inches. In that case, an inside diameter of a younger hitter's batting swing device would be approximately 2–⅜".

The device 11 is slidably placed on a baseball bat 14, as best shown in FIG. 6. The device rests around the lower handle 28 of the bat, on top of the batter's hands, as best shown in FIG. 6. When the batter swings the bat in a simulated attempt to hit a pitch, centrifugal force causes the device to slide off the bat. As previously described, the type of swing taken by the hitter determines the direction in which the device will travel and the final resting place of the device. The travel of the device once it slides off the barrel 29 of the bat indicates the direction the hands are traveling during the swing, which in turn indicates the direction of travel of the barrel of the bat and the length of time the barrel of the bat would be in perpendicular line to the line of the pitch.

One method of use of the device is in conjunction with a batting cage. A batting cage is an essentially rectangular cage. The cage has two longer sides and two ends, which are generally covered with netting or other material to keep the ball within the batting cage. In utilizing this device with a batting cage, a hitter slides the device over the end of the barrel of the bat and allows it to slide down the bat handle and to rest upon the batter's hands (as best shown in FIG. 6). After swinging the bat, the hitter observes where the device contacts the batting cage after leaving the bat. If the device contacts the batting cage within the 50 degree zone (end 16 of the cage), the hitter can assume his hands moved the bat along an appropriate line perpendicular to the line of the pitch. If the device contacts the batting cage outside the 50 degree zone on either side, the hitter knows his hands traveled in an inappropriate line, either away from his body too quickly or inside the desired line.

As shown on FIG. 8, the desired 50 degree zone is illustrated, while the undesirable zones 15 and 15' indicate that the swing taken was incorrect.

For batting cages that are approximately 10 feet wide at the hitting end 16, the batter should stand approximately 11 feet from the hitting end 16 of the cage. This will create the desired correct 50 degree hitting angle. If the batting cage is 12 feet wide, the batter should stand approximately 13 feet from the hitting end of the cage. If the batting cage is 14 feet wide, the batter should stand approximately 15 feet from the hitting end of the cage.

A second way to use the device is with the packaged 25 foot long polypropylene rope. This method allows a hitter with no batting cage to use the device. A hitter simply places the looped end of the rope around the handle of the bat and places the other end of the rope through any one of the four 0.1875 inch holes. After tying a knot in the end of the rope so that the device stays attached to the rope, the hitter slides the device over the barrel end of the bat and allows it to slide down the bat and come to rest on top of the hitter's hands. The hitter then swings the bat and observes the direction the device travels. Again, it is desirable to have the device travel on a line in the direction where a pitcher would be located or within 25 degrees on either side of the pitcher's mound, as shown at 3 in FIG. 1 and on FIG. 7. The pitcher's mound is shown at 17 on FIG. 7. The third base side of the pitcher's mound is shown at 18 while the first base side of the pitcher's mound is shown at 19.

As shown in FIG. 2, when the batter uses the improper swing previously described, the device will travel in the direction of the arrow 20, as shown. When the incorrect swing is made, as shown in FIG. 3, the device will travel in the direction 21 as shown. However, when the correct swing is made, the device will travel essentially straight out, as shown in the direction of the arrow 30 on FIG. 4, or within a 50 degree angle from the pitcher's mound and homeplate area as shown on FIG. 7.

This device is a simple but useful device and method for determining the swing of a baseball hitter. It may be used indoors or outdoors and may be used with or without a batting cage. By simply observing the flight of travel of the device, the hitter will know whether or not he has made a correct swing, and will be able to determine what flaws exist in his swing if it is a bad one.

Having fully described my device, I claim:

1. A batter swing device for a tapered baseball bat wherein said bat has a narrow handle end and a larger barrel end comprising:

a circular ring having a rounded outer circumferential surface;

wherein said circular ring has upper and lower flat surfaces integrally joined to said rounded outer surface and wherein either of said upper or lower surfaces are adapted to rest on top of a batter's hands when said device is placed over the barrel end of said device;

wherein said upper and lower flat surfaces are parallel to each other and perpendicular to the inner circumferential surface of said circular ring;

an inner, flat circumferential surface wherein said flat, perpendicular inner surface fits snugly over the barrel end of said bat yet allows said device to slide off of said bat when the batter swings;

said circular ring further comprising a plurality of small holes cut through the thickness of said circular ring, wherein the holes on the circular ring are adapted to receive one end of a rope and the other end of a rope is attached to a baseball bat;

whereby said inner diameter and inner perpendicular surface allows said device to slide off of said tapered bat in the same direction of travel each time the batter swings the bat in the same way.

2. A method for determining a proper or improper batter's swing, said method comprising the steps of:

(a) sliding a doughnut-shaped batter swing device having an outer diameter of approximately five inches, an inner diameter greater than the maximum outer diameter of the barrel end of said bat, and a cross-section of approximately one-half inch over the barrel of a baseball bat;

(b) allowing said batter swing device to rest on a batter's hands as the batter swings the bat;

(c) observing the direction that said batter swing device travels as it slides off the barrel of the bat during the swing.

* * * * *